US005685100A

United States Patent [19]

Atchison

[11] Patent Number: 5,685,100

[45] Date of Patent: Nov. 11, 1997

[54] BULLET CARTRIDGE CASING IDENTIFICATION SYSTEM

[76] Inventor: Richard G. Atchison, 28905 NE. Sunset Falls Rd., Yacolt, Wash. 98675

[21] Appl. No.: 524,092

[22] Filed: Sep. 7, 1995

[51] Int. Cl.[6] ..... F41C 27/00

[52] U.S. Cl. ..... 42/1.01; 102/430

[58] Field of Search ..... 42/1.01, 76.01; 102/501, 430, 431, 513–518

[56] References Cited

U.S. PATENT DOCUMENTS

| | | | |
|---|---|---|---|
| 1,650,908 | 11/1927 | Ramsey | 102/430 |
| 1,887,324 | 11/1932 | Pocoroba | 102/501 |
| 2,592,434 | 4/1952 | Krasnow | 102/501 |
| 3,442,172 | 5/1969 | Wehrmann et al. | 42/76.01 X |
| 3,562,945 | 2/1971 | Mikola | 42/76.01 X |
| 3,777,385 | 12/1973 | Hagan | 42/76.01 X |
| 4,035,942 | 7/1977 | Wiczer | 42/76.01 X |
| 4,150,624 | 4/1979 | Hammond | 102/501 |
| 4,175,346 | 11/1979 | Zemsky | 42/76.01 |
| 4,222,330 | 9/1980 | Krystyniak | 102/430 |
| 5,485,789 | 1/1996 | Collier | 102/501 |
| 5,511,483 | 4/1996 | Griffin, Jr. | 102/501 |

*Primary Examiner*—Michael J. Carone
*Assistant Examiner*—Matthew J. Lattig
*Attorney, Agent, or Firm*—James J. McKeever

[57] ABSTRACT

The present invention relates to the fire arm industry and more particularly to a system that impresses a bar type code into the brass cartridge casing that has been fired from a gun. The identifying markings are placed on the gun with as little visibility as possible but enough to form the code to identify the fired casing as being from one specific handgun, rifle or shotgun. The code markings may be placed on the bolt, breech and/or the firing pin of any firearm without effecting its operation in any way. The identifying code markings are impressed on the surface of the shell casing when the firearm is fired. These identifying code marks may be placed at the outer rim surface, inside the primer area rim, on the primer its self or in multiple places on the shell casing. The identifying code markings are similar to bar code markings and directly relates the spent casing that has been fired by a firearm, to that firearm. The system of the present invention is especially useful for criminal investigations of a crime seen in which a firearm was used.

5 Claims, 5 Drawing Sheets

BULLET CARTRIDGE CASING IDENTIFICATION SYSTEM

FIELD OF THE INVENTION

The present invention relates to the field of brass cartridge case marking, especially for the field of criminal investigation.

CROSS-REFERENCE TO RELATED APPLICATION

My copending U.S. patent application, Ser. No. 08/524,093 filed of even date, is related to this present application and discloses a system for bar type code identification of a bullet that is fired from the barrel of any firearm. The system of my copending application may be used in connection with the system of the present invent ion and is entitled:

BULLET CODE IDENTIFICATION SYSTEM

BACKGROUND OF THE INVENTION

The following art has been found to be related to the field of the present invention but in no way does any of the herein cited references anticipate or even suggest the novel advance in the art that is made by the present invention.

U.S. Pat. No. 4,035,942, issued to Wiczer on 19 Jul. 1977 and entitled Bullet Identification, relates to a device that is installed on the inside surface wall of a gun barrel. This invention can mark a bullet with a code but it also can, with continued use and neglect, become the cause of the barrel to explode. The system in the Wiczer Patent alters the barrel substantially and as such, makes the barrel unusable if an attempt to remove it is made. The Wiczer system would leave debris in the barrel unless it is cleaned after each firing, this is a very dangerous condition. The system of Wiczer is so obvious to the eye that if the user is a criminal, he would most certainly attempt to remove it, thereby creating even a more dangerous condition.

U.S. Pat. No. 4,175,346, issued to Zemsky on 27 Nov. 1979 and entitled Firearm and Bullet Identification, relates to a system that also substantially, the interior of the gun barrel. The barrel of the firearm is altered to such a degree that any bullet that is fired through such an altered barrel would lose enough velocity so as to leave the bullet that was fired larged in the barrel and this is a very dangerous situation. In addition, the bullet would be so changed in shape that its accuracy would be minimal. The cost of such a change in the firearm barrel would be prohibitive and would ad additional weight to the barrel and make it impracticable, undesirable and dangerous.

OBJECTS OF THE INVENTION

An object of the present invention is to provide a system of marking the brass casing cartridge shell of a bullet or shot shell fired from any type of firearm, with an identifying bar type code in order to relate that shell with that particular firearm.

A further object of the present invention is to provide a system of marking the brass casing cartridge shell of a bullet or a shot shell with an identifying bar type code that is safe and does not effect the firing of the firearm.

An additional object of the present invention is to provide a system of marking the brass casing cartridge shell of a bullet or shot shell with an identifying bar type code that does not effect the accuracy of the bullet or the shot that is fired.

A still further object of the present invention is to provide a system of marking the brass casing cartridge shell of a bullet or shot shell with an identifying bar type code that is relatively inconspicuous to a gun user.

Various other objects, advantages and features of the present invention will become apparent to those skilled in the art from the previous and following discussions, taken in conjunction with the accompanying drawings, which constitute part hereof.

SUMMARY OF THE INVENTION

The present invention is a system to impose an identifying marking code, similar to a bar code, on the brass casing cartridge shell to identify that that that shell was fired from that firearm. A bar code is defined in The Random House International Unabridged Dictionary, 2nd Edition, 1993. The identifying code of the present invention is imposed with a depth of from about 0.00510 centimeters to about 0.0130 centimeters and with as little visibility as possible and is almost invisible to the user. The present invention is accomplished by imposing microscopic ridges, points and/or grooves on the bolt, chamber neck and/or the firing pin of any type of fire-arm. Identifying marks that are only on that firearm are left on the casing shell when it is fired from that firearm. The marks may be left on the outer rim, between the outer rim and the primer rim, between the primer rim and the primer area and on the primer itself. It is also contemplated to have markings on more than one location because many shells are reloaded.

When the bullet or shot shell is fired, the tremendous force that is created causes the ridges, points and/or the grooves machined on the bolt, chamber or firing pin to impress its particular design on the surface of the spent brass casing cartridge shell. The main reason for placing more than one set of markings, especially when one of these locations is the primer, is because of the reloading of shells by many shooters.

The identification system of the present invention does not, in any way, interfere with the operation of any firearm, does not cause any dangerous situation to accrue and there is no effect on the accuracy or the velocity of the bullet or shot that is fired from the weapon so marked with the inconspictuous ridges, points and/or grooved of the present invention.

DETAILED DESCRIPTION OF THE PREFERRED EMBODIMENT OF THE PRESENT INVENTION

Figure 1:
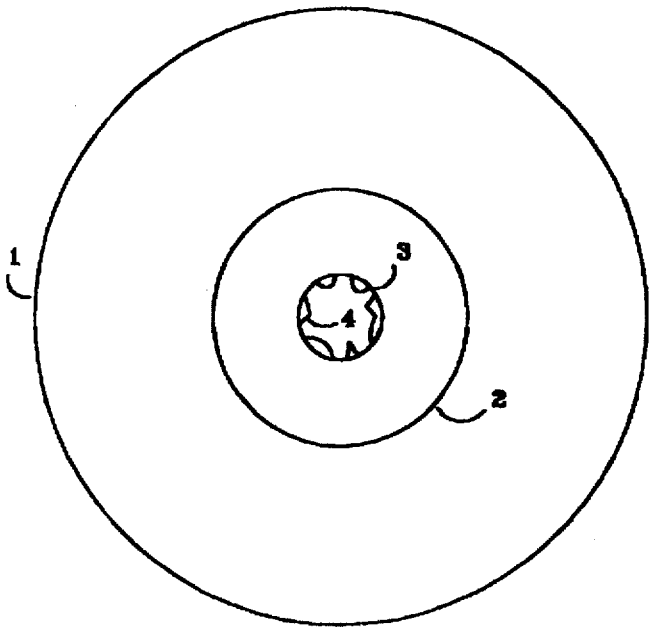
FIG. 1 is a plan view of the base of a brass casing cartridge shell of a center-fire cartridge having been fired by a firearm that has the bar type code of ridges, points and/or groves of the present invention engraved or machined on its bolt, breech and/or firing pin, with the identifying markings on the primer area.

Referring now to FIG. 1, the base of a center-fire brass shell casing is shown at 1, the primer rim is at 2, primer area is at 3 and the ridges, points and groves of the present invention are shown at 4, embedded into the primer area 3.

Figure 2:
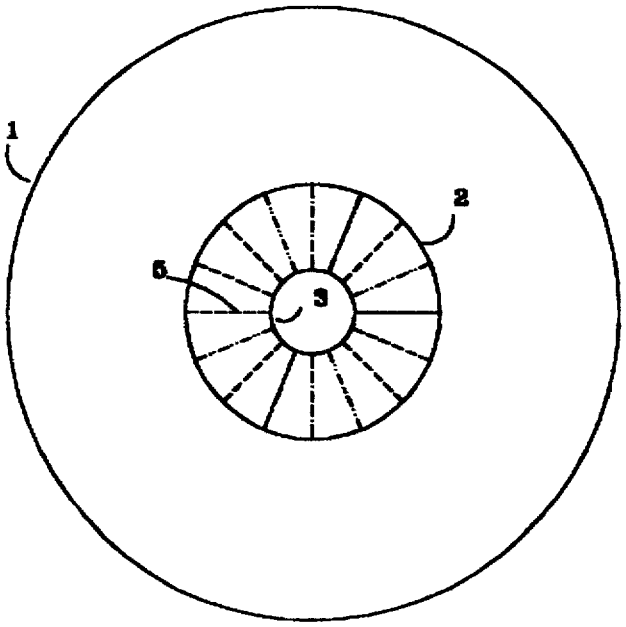
FIG. 2 is a plan view of the base of a brass casing cartridge shell of a center-fire cartridge that has been fired from a firearm that has the bar type code of ridges, points and/or groves of the present invention engraved or machined on its bolt, breech and/or firing pin, with the identifying markings on the casing extending outwardly from the primer area.

FIG. 2, shows the base of a centerfire brass shell casing with the outer rim at 1 as in FIG. 1, the primer rim is at 2, the primer area is at 3 and the ridges, points and groves 5 of the present invention are shown fanning out from the primer area 3.

Figure 3:
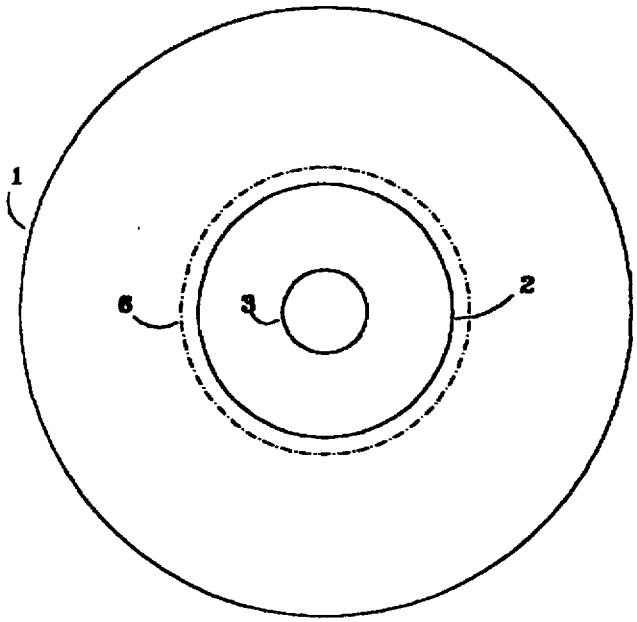
FIG. 3 is a plan view of the base of a brass casing cartridge shell of a center-fire cartridge that has been fired from a firearm that has the bar type code of ridges, points and/or groves of the present invention engraved or machined on its bolt, breech and/or firing pin, with the identifying marks in a circle around the primer area.

FIG. 3, shows the base of a centerfire brass casing with the outer rim at 1, the primer rim is at 2, the primer area is at 3 and the ridges, points and groves 6 of the present invention are show circling the primer rim at 2.

Figure 4:
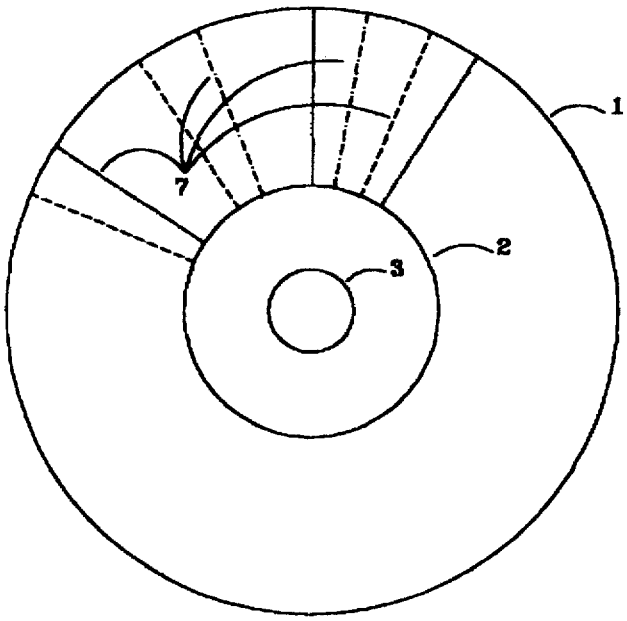
FIG. 4 is a plan view of the base of a brass casing cartridge shell of a center-fire cartridge that has been fired from a firearm that has the bar type code of ridges, points and/or groves of the present invention engraved or machined on its bolt, breech and/or its firing pin, with the identifying marks extending outwardly from the primer rim.

FIG. 4, shows the base of a centerfire brass casing with the outer rim at 1, the primer rim is at 2, the primer area is at 3 and the ridges, points and groves 7 of the present invention are shown extending outwardly from the primer rim 2.

Figure 5:
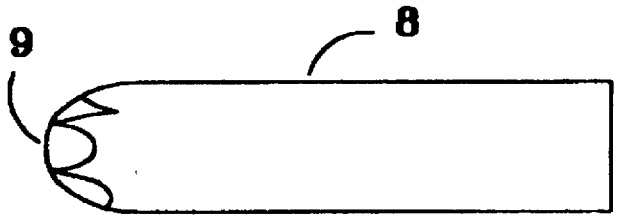
FIG. 5 is a side view of a firing pin showing identifying marks on the leading edge of said firing pin.

In FIG. 5, the firing pin of a center-fire firing arm is shown at in a side view at 8 and the ridges, points and groves of the present invention are shown at 9.

Figure 6:
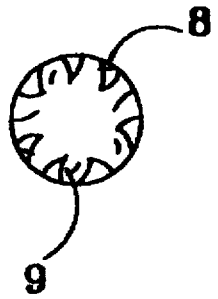
FIG. 6 is a front view of the firing pin as shown in FIG. 5.

FIG. 6, is a front view of firing pin 8 of FIG. 5 and the ridges, points and groves of the present invention is likewise shown at 9.

Figure 7:
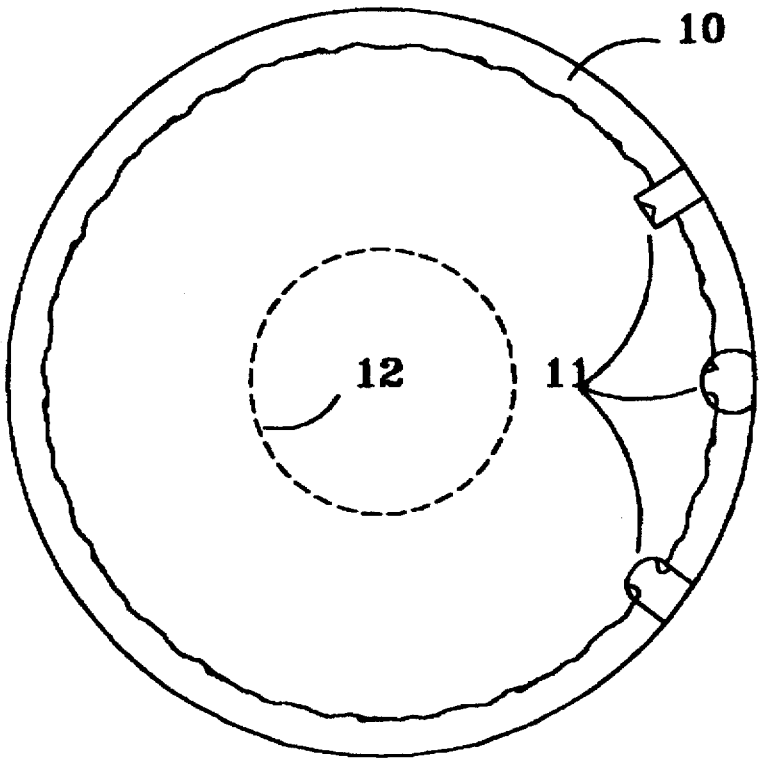
FIG. 7 is a plan view of the base of a brass casing cartridge shell of a rim-fire cartridge with the bar type markings of the present invention impressed thereon.

In FIG. 7, the base of a rim-fire cartridge is shown with its outer rim at 10, the ridges, points and groves of the present invention are at 11 at and around the rim 10 and the same ridges, points and groves of the present invention are also shown at 12. It should be noted that any number of location combinations of identifications may be used in both center-fire or rim-fire.

Figure 8:
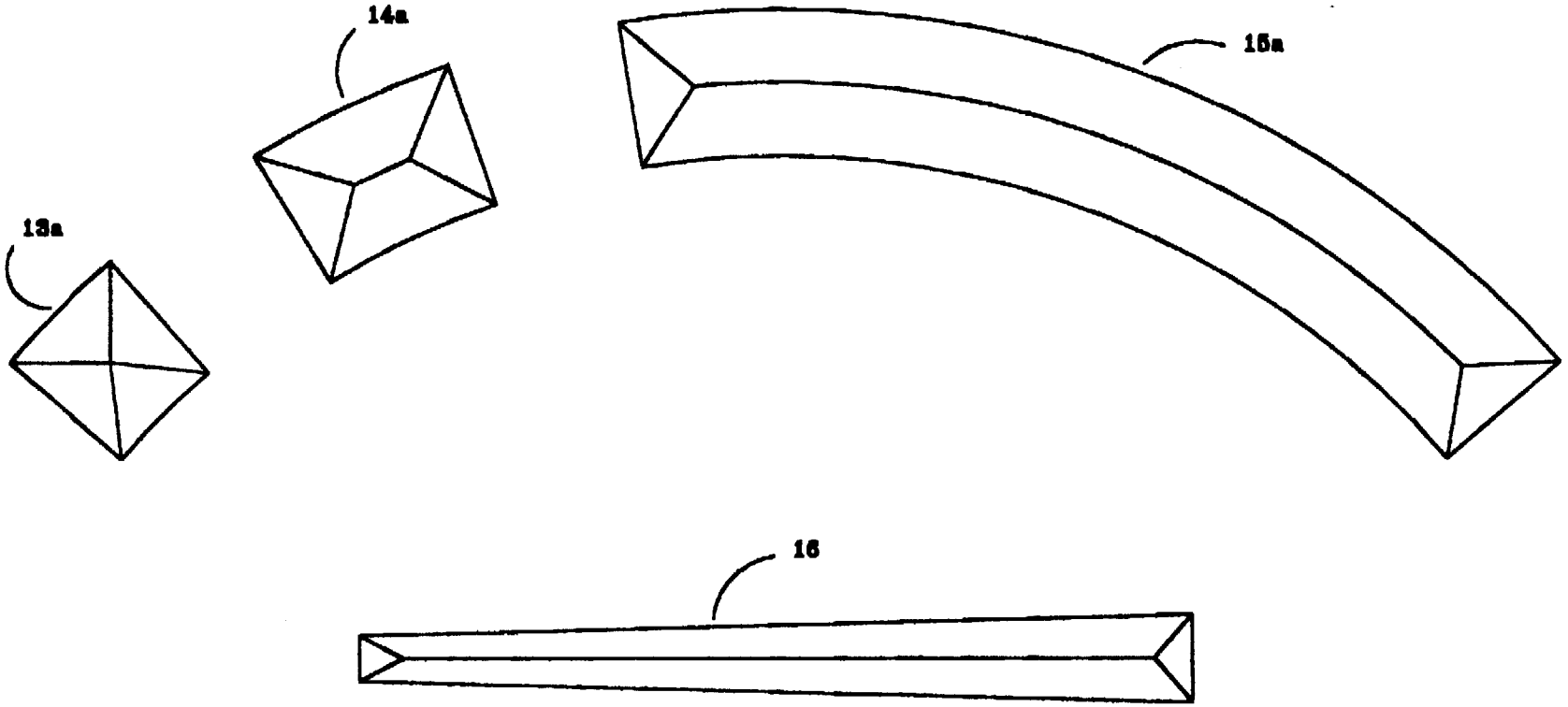
FIG. 8 is a top view of the various identifying ridges, points and grooved that are used in the system of the present invention on the bolt, breech and/or the firing pin of any type of firearm.

FIG. 8, shows a top view of the ridges, points and groves that have empressed the bar type code into the bases of the brass shell cartridges as shown in FIGS. 1–7, with the straight line or individual markings shown as a point at 13, a short ridge at 14 and a long ridge at 15. The tapered long ridge 16 is shown to demonstrate that there may be any number of variations in the shape, height and/or length of the ridges, points and groves of the present invention. Point 13*a*, short ridge 14*a* and long ridge 15*a* are shown together in a circular arrangement.

Figure 9:
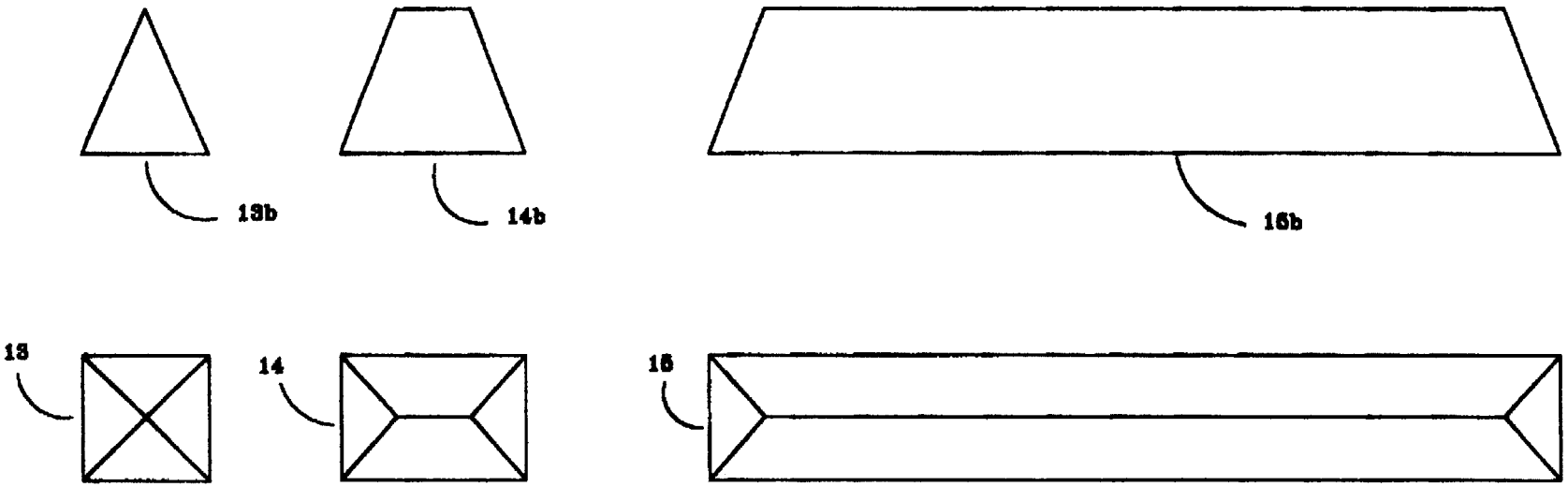
FIG. 9 is a cross-sectional view of the various identifying ridges, points and groves as shown in FIG. 8, that are used to engrave or embosed identifying marks on spent shell casings shot from one specific firearm.

FIG. 9 shows a cross sectional view of point 13 as 13*b*, short ridge 14 as 14*b* and 15 as 15*b*.

The identifying ridges, points and groves used in the identifying bar type code markings of the present invention may be of any shape, height, length and design as desired. These ridges, points and groves of the present invention may be engraved or embossed on the firing pin, the breach or the bolt of any type of fire-arm whether it be a single shot hand gun, rifle or shotgun, a single action hand gun, rifle or shotgun, a multi barreled rifle or shotgun or a semi-automatic hand gun, rifle or shotgun. Even a fully automatic machine gun or assault weapon (assault weapons are only automatic hand guns, rifles or shotguns, no semi-automatic weapon is an assault weapon) can be identifiably marked with the ridges, points and/or groves of the present invention.

While the description, supra., contains many specificities, the reader should not construe these to be limitations on the scope of the invention, but merely as exemplifications of a preferred embodiment of the present invention. Those skilled in the art will envision that many other possible variations are within the scope of the present invention. For example, skilled artisans will readily be able to change the dimensions and the materials of the various embodiments. They can make many variations on the design of the present invention. Accordingly, the reader is requested to determine the scope of the present invention only by the scope of the appended claims and their legal equivalents, taken in view of the scope this specification, and not by the examples that have been given herein.

What is claimed is:

1. A system for identifying the spent brass cartridge that is fired from a gun comprising imposing microscopic markings selected from the group consisting of grooves, points and ridges on that portion of the gun selected from the group consisting of the bolt face, and the firing pin, said markings impressed on the surface of the spent cartridge left in the chamber of the gun upon the firing of said gun.

2. The system of claim 1 wherein the marking imposed on the surface of the cartridge left in the chamber of said gun is in the form of readily recordable and identifiable bar code marking.

3. The system of claim 1 wherein said microscopic bar code markings that are imposed on that part of the gun that is selected from the group consisting of the bolt face and, the firing pin are of a depth of from about 0.00510 centimeters to about 0.0130 centimeters.

4. The system of claim 1 wherein said microscopic markings that are in the gun and the resulting markings on the spent brass cartridge in the form of grooves, points and ridges are of varying depths and widths.

5. A system for identifying a spent brass cartridge from a fired gun consisting of imposing microscopic code markings selected from the group consisting of grooves, points and ridges, on that portion of the gun selected from the group consisting of the bolt face, and the firing pin, said markings being in the form of readily recordable and identifiable bar code markings, said markings impressed to a depth of from about 0.00510 centimeters to about 0.0130 centermeters and of varying widths, said markings are left on the surface of said spent cartridge upon the firing of said gun.

* * * * *